United States Patent [19]

Garmong

[11] 4,377,092

[45] Mar. 22, 1983

[54] WELL PUMP JACK WITH CONTROLLED COUNTERBALANCING

[75] Inventor: Victor H. Garmong, Kennerdell, Pa.

[73] Assignee: Pioneer Electric Supply Co., Inc., Franklin, Pa.

[21] Appl. No.: 168,035

[22] Filed: Jul. 14, 1980

[51] Int. Cl.[3] ..... F16H 21/32

[52] U.S. Cl. ..... 74/41

[58] Field of Search ..... 74/41, 589-591

[56] References Cited

U.S. PATENT DOCUMENTS

| | | | |
|---|---|---|---|
| 1,359,644 | 11/1920 | Wright | 74/590 |
| 1,795,922 | 3/1931 | Baker | 74/41 |
| 2,198,348 | 4/1940 | Porter | 74/41 |
| 2,286,153 | 6/1942 | Nicolescu | 74/41 |
| 2,380,686 | 7/1945 | Cummins | 74/41 |
| 2,432,735 | 12/1947 | Downing . | |
| 2,722,850 | 11/1955 | Tucker | 74/590 |
| 2,841,992 | 7/1958 | Chastain . | |
| 2,940,335 | 6/1960 | Mitchell . | |
| 2,995,048 | 8/1961 | Mitchell et al. . | |
| 3,209,605 | 10/1965 | Scoggins . | |
| 3,230,782 | 1/1966 | Harryman et al. | 74/41 |

*Primary Examiner*—Lawrence J. Staab

*Attorney, Agent, or Firm*—Carothers & Carothers

[57] ABSTRACT

A deep well pump jack having a walking beam pivotally mounted on a Samson post with sucker rods depending from one end of the walking beam and a counterbalancing weight carried by the other end of the walking beam, and a prime mover is provided to rock the walking beam up and down in operation through pumping cycles. During pumping cycles, the counterbalancing weight is moved or driven in movement relative to the walking beam such that the center of gravity of the counterbalancing weight follows a vertical pattern of movement throughout each pumping cycle wherein the center of gravity travels in a substantially straight line while traveling upward and in a line of curvature directed outwardly away from the Samson pivot while traveling downward to compensate for the varying loads placed on the prime mover during each pumping cycle.

18 Claims, 3 Drawing Figures

10
11
12
13
14
15
16
17
17a
17b
17c
18
19
20
21
22
23
24
25
26
27
28
29
30
31
32
33
34
35a
35b
35c
35d
36
37
38
39
40
41
45
46
II

WELL PUMP JACK WITH CONTROLLED COUNTERBALANCING

BACKGROUND OF THE INVENTION

The present invention relates generally to deep well pumps of the type used to recover subterranean oil deposits, and, more particularly, to deep well pumps of the type in which the pumping motion is originated at the surface of the ground and transmitted through a reciprocating string of rods to a pump located within the well bore. Yet more particularly, the present invention is especially concerned with an improvement in the efficiency with which the fluid and mechanical loads imposed upon the pumping unit of the type described may be counterbalanced.

In deep well pumps, such as oil well pumps, of the type in which the pumping motion of the subsurface pumping equipment originates at the surface of the ground (as opposed to subsurface pumps in which the pumping motion originates below the surface of the ground), effective counterbalancing of the pumping unit to reduce the load on the prime mover and power translating equipment is extremely important. Irregularities or inequalities in loading that fall upon the sucker rods during different parts of the pumping cycle impose a difficult operating problem on the prime mover, tending to cause irregularities in speed and creating a variable and rapidly fluctuating power demand. With regard to fluctuation in power demand, if, for example, the energy source for the pump prime mover is electric, these irregularities imposed on the power demand require that the entire electrical system for the pump including the source and the motor be rated for peak amperage demands. Thus, in improperly counterbalanced pumping systems, not only must more expensive motors and power hookup connections be supplied, but in addition, the cost of the electrical energy supply is increased, as it is metered on the basis of peak current loads or demand.

Furthermore, regarding structural failures, in conventional oil well sucker rod pumps, it has been estimated that about 90 percent of the failures of speed reduction gearing, pitmans, bearings and shafts result from improper counterbalancing. The primary purpose in counterbalancing a pumping unit is to reduce the effective peak load on the prime mover, the energy source for the prime mover, and the gear box through which the prime mover drives the unit so that smaller engines, less fuel or energy, and less massive speed reduction gearing can be employed. This in turn results in great economic savings, since it is less expensive to supply counterbalancing weights than it is to provide the heavier, more complicated engines or motors and gear reduction systems, and more expensive fuel or energy consumption costs necessary to drive the pumping unit without the assistance of effective counterbalancing.

In an ideally counterbalanced system, the total load imposed upon the pumping unit by the fluid load lifted by the pump, plus the weight of the rods and losses due to friction, etc., would be substantially completely offset by a counterbalance applying an opposing force to the motor. However, the systems heretofore most widely used have at best been effective to counterbalance a downwardly acting force equal to the weight of the rods used to pump the liquid, plus one-half of the weight of the fluid lifted by the pump. Under this arrangement, the net load lifted during the upstroke of the pump equals the load applied to the pump through the sucker rod string less the countereffect of the counterbalance. Since, during the upstroke, the static load on the pumping equipment consists essentially of the weight of the rods plus the weight of the fluid, the net load on the system when the counterbalance effect is subtracted equals half of the weight of the fluid lifted. On the downstroke, on the other hand, the net load equals the counterbalance weight less the weight of the falling rods, or again, approximately half the weight of the fluid lifted on the upstroke. The net load on the prime mover and gear box is therefore equal during the upstroke and the downstroke. Thus, the peak load occurring during each stroke is considerably less (by the amount of approximately half the weight of the fluid load) than the peak load imposed on the unit through the sucker rod string without benefit of any counterbalancing. Nevertheless, in such conventional counterbalancing systems, the loads imposed on the prime mover are not fully counterbalanced throughout each pumping cycle, as the load of approximately half the weight of the fluid load during each stroke is not counterbalanced.

For a number of years, efforts have been directed to the more effective counterbalancing of the torque imposed on the prime mover and gear reducer of deep well pumps of the type described. Generally, however, such efforts, while in some instances being effective to reduce the peak torque transmitted to the driving mechanism from the rod string, have increased the cost of the pumping unit to the extent that an improvement in counterbalancing over that which is most widely currently attained has not been found to be economically justified. In addition, such efforts have also resulted in counterbalancing systems wherein the center of gravity of the counterbalancing weight for the pump jack travels in a vertical pattern of movement throughout each pumping cycle which takes on the configuration of a straight line, an oval or a circular configuration. When the center of gravity of the counterbalancing weight simply travels up and down in a straight line throughout each pumping cycle, the counterweight is not being effective to compensate for inequalities in loading that fall upon the sucker rods during different parts of the pumping cycle. The same holds true when the center of gravity of the counterbalancing weight travels in a pattern of a uniform or balanced oval or circle throughout each pumping cycle, as the loading which falls upon the sucker rods during the different parts of the pumping cycles does not vary with such uniformity or regularity during and when transitioning from and to upstrokes and downstrokes of the pump. Also, while some of the pump counterbalancing systems of the prior art do improve the problem of counterbalancing against the irregularities in loading during different parts of the pumping cycle, they do not, to a desirable degree, effectively redistribute the load placed on the prime mover and gear box throughout each pumping cycle to a more uniform load distribution.

One of the earlier efforts to depart from the conventional counterbalancing technique was that of V. A. Nicolescu described in U.S. Pat. No. 2,286,153. In this system, Nicolescu utilized the lemniscate linkage system and parallelograms in order to convert rotary paths of the pump drive and/or walking beam into rectilinear paths in order that the sucker rods and the counterbalance weight will move up and down during pumping cycles in vertical parallel paths of movement. Thus, while the Nicolescu structure insured rectilinear movement of the sucker rods, it did not resolve the problem of counterbalancing to compensate for the irregularities in loading that fall upon the sucker rods during different parts of the pumping cycle.

Another effort to more effectively counterbalance the well load suspended from the walking beam is disclosed in Downing U.S. Pat. No. 2,432,735. In the Downing Patent, a counterweight is slidably mounted on the walking beam and is shifted by a hydraulic cylinder carried by the walking beam in a properly timed sequence to counterbalance the well load. The system, however, still required a separate prime mover and gear reduction system for driving the walking beam in an oscillating movement which would synchronize with the activation of the weight shifting hydraulic cylinder. In addition, the system does not compensate for the fact that as the counterweight in either position shifts on the end of the walking beam and travels up and down with the walking beam, its center of gravity travels in an arc created by the pivotal movement of the walking beam about the Samson post pivot, thereby undesirably changing the effective counterweight during each stroke.

Other efforts at improving counterbalancing effects by mounting a shifting weight on the walking beam of the pump whereby changing the moment of the counterweight are described in Mitchell U.S. Pat. Nos. 2,940,335 and 2,995,048, and Chastain 2,841,992. Chastain's system in particular claims to go far towards reducing the peak load imposed on the prime mover and speed reducer during both the upstroke and the downstroke as a result of changing the effective moment of the counterbalance by changing the leverage of the counterweight as it is applied to a crank arm connected directly to the speed reducer. This, in fact, is a desired advantage. However, two of the systems require the addition of a second prime mover to move the counterweight, and these systems still cannot adequately or economically compensate for the loading irregularities to the degree required by present energy demands, particularly in view of the high cost of manufacture of these systems.

Another counterbalancing system for deep well pumps is illustrated in Scoggins U.S. Pat. No. 3,209,605, wherein the counterbalancing weight is reciprocally mounted on the walking beam, and the prime mover for the pump is also mounted reciprocally on the mounting beam and imparts oscillating motion to the walking beam as well as reciprocating motion to the counterbalance weight. The counterbalancing weight is moved in a generally circular path or pattern of vertical movement during pumping cycles. As previously pointed out, movement of the center of gravity of the counterweight through a vertical path of movement which is balanced or uniform in the form of a circle cannot fully compensate for the inequalities in loading that fall upon the sucker rods during different parts of the pumping cycle, as the variations in loads between upstrokes and downstrokes of the pump and transition between these strokes does not vary in such a uniform manner. It is this basic principle that, while the prior art may show improvements, it does not adequately compensate for when considered in conjunction with other considerations such as cost of manufacture of the pump jack in combination with the ability to change the leverage of the counterweight as it is applied to the crank arm to accordingly reduce the peak load imposed on the prime mover and speed reducer and to more uniformly distribute that load throughout the pumping cycle. It is a principal object of the present invention to eliminate or at least substantially reduce all of the aforesaid deficiencies found in the well pumping apparatus of the prior art.

SUMMARY OF THE INVENTION

The well pumping apparatus of the present invention includes the usual pump jack elements of a Samson post with a walking beam pivotally mounted intermediate its end portions on the Samson post and means to connect a string of sucker rods to one end portion of the walking beam and a counterbalancing weight carried by the other end portion of the walking beam. A prime mover or power connecting means is connected to rock the walking beam up and down in operation through pumping cycles. The counterbalancing weight carried by the walking beam is mounted so that it is movable relative to the walking beam and the counterbalancing weight is uniquely driven relative to the walking beam during each pumping cycle such that the center of gravity of the counterbalancing weight follows a vertical pattern of movement throughout each pumping cycle wherein the center of gravity travels in a substantially straight line while traveling upward and in a line of curvature directed outwardly away from the Samson pivot while traveling downward. The straight line of upward movement will generally be substantially vertical, in view of the fact that when the sucker rods are lowered into the well, they travel in a straight line.

This particular vertical pattern of movement of the counterbalancing weight center of gravity better compensates for the inequalities or irregularities in loading that fall upon the sucker rods during different parts of the pumping cycle than is possible with the systems of the prior art. The load of the sucker rods or the weight of the sucker rods when falling or being lowered into the well does not substantially vary at all, and it is thus desired that during this downstroke pumping movement the center of gravity of the counterbalancing weight travel upwardly in a substantially straight line. Yet on the upstroke of the pump, the added weight of the fluid or liquid being lifted requires that the center of gravity of the counterweight move outwardly away from the Samson pivot during the pumping upstroke or downward movement of the center of gravity of the counterweight.

In the preferred embodiment of the present invention the counterbalancing weight is moved relative to the walking beam throughout pumping cycles directly by means of the prime mover and connecting means which operatively rocks the walking beam, and the prime mover and connecting means for rocking the walking beam up and down about the Samsom pivot includes a pitman crank. The counterbalancing weight is hingedly connected to the end portion of the walking beam for swinging movement about an axis parallel to the axis of the Samson pivot, and a lever arm connection or connections pivotally connect the counterbalancing weight with the pitman crank assembly to hingedly move the center of gravity of the counterbalancing weight longitudinally relative to the Samson pivot during pumping cycles to thereby guide the center of gravity of the counterweight to follow a predetermined vertical pattern of movement throughout each pumping cycle of the walking beam. In this manner, not only can the vertical pattern of movement of the center of gravity of the counterweight be predetermined throughout each pumping cycle, but in addition, the leverage of the counterweight is variably applied to the pitman crank assembly to more uniformly reduce and distribute or redistribute the peak loads imposed on the prime mover and speed reducer through each complete pumping cycle.

The lever arm means used to pivotally connect the counterbalancing weight with the prime mover and pitman crank assembly, or most generally directly with the pitman post, is connected at predetermined positions of connection in order to obtain the desired predetermined pattern of vertical movement for the center of gravity of the counterweight. In other words, the location of pivot connections and the length of interconnecting lever arms found within this lever arm means which pivotally connects the counterbalancing weight to the pitman can all be varied to obtain the proper predetermined pattern or vertical movement through both upstrokes and downstrokes of each pumping cycle. This lever arm means will generally not intermediately engage the walking beam itself, as it must move the counterweight relative to the walking beam.

In one embodiment of the present invention wherein a pitman crank is used in conjunction with the prime mover for the pump, the lever arm means which connects the pitman post to the hinged counterweight consists, in combination, of a pitman arm extension of the pitman post which extends upwardly above the walking beam or above the pitman post pivot connection to the walking beam to a free end position, and a leverage arm is secured to the counterweight and extends upwardly therefrom to a free end position above the hinged connection of the counterweight to the walking beam, and a connecting member extends between and pivotally connects these two free ends together to complete the leverage system which controls the hinged movement of the counterbalancing weight relative to the walking beam. This latter-mentioned connecting member extending between the free ends may be varied in length to compensate for minor variations in counterweight effect on the prime mover.

This lever arm means may also consist, in another embodiment example, of a rigid lever arm pivotally connecting the hinged counterbalancing weight with the pitman post at predetermined positions of connection below the walking beam, as opposed to being above the walking beam as described in the aforesaid example. Again, the connecting levers may be made adjustable to accordingly vary the vertical pattern of movement for the center of gravity of the counterbalancing weight.

In these two latter-mentioned embodiments, not only is the movement of the center of gravity of the counterweight controlled, but the counterweight applies leverage directly to the pitman post, which tends to assist the prime mover, including the motor and gear box, during portions of each pumping cycle to more uniformly distribute or redistribute the load thereon throughout the cycle, or at least a portion thereof.

Another improvement in the well pumping apparatus of the present invention resides in positioning the prime mover under the walking beam between the Samson pivot and the end of the walking beam which carries the counterbalancing weight. Unlike conventional prime mover systems, the prime mover consists of a geared speed reduction assembly with the motor drive therefor mounted directly on top of the speed reducer instead of off to the side, thereby providing a more compact prime mover and also providing adequate room for the hinged counterbalancing weight to move in order to avoid contact by the counterweight with the prime mover assembly during pumping cycles.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DETAILED DESCRIPTION OF THE DRAWINGS

Figure 1:
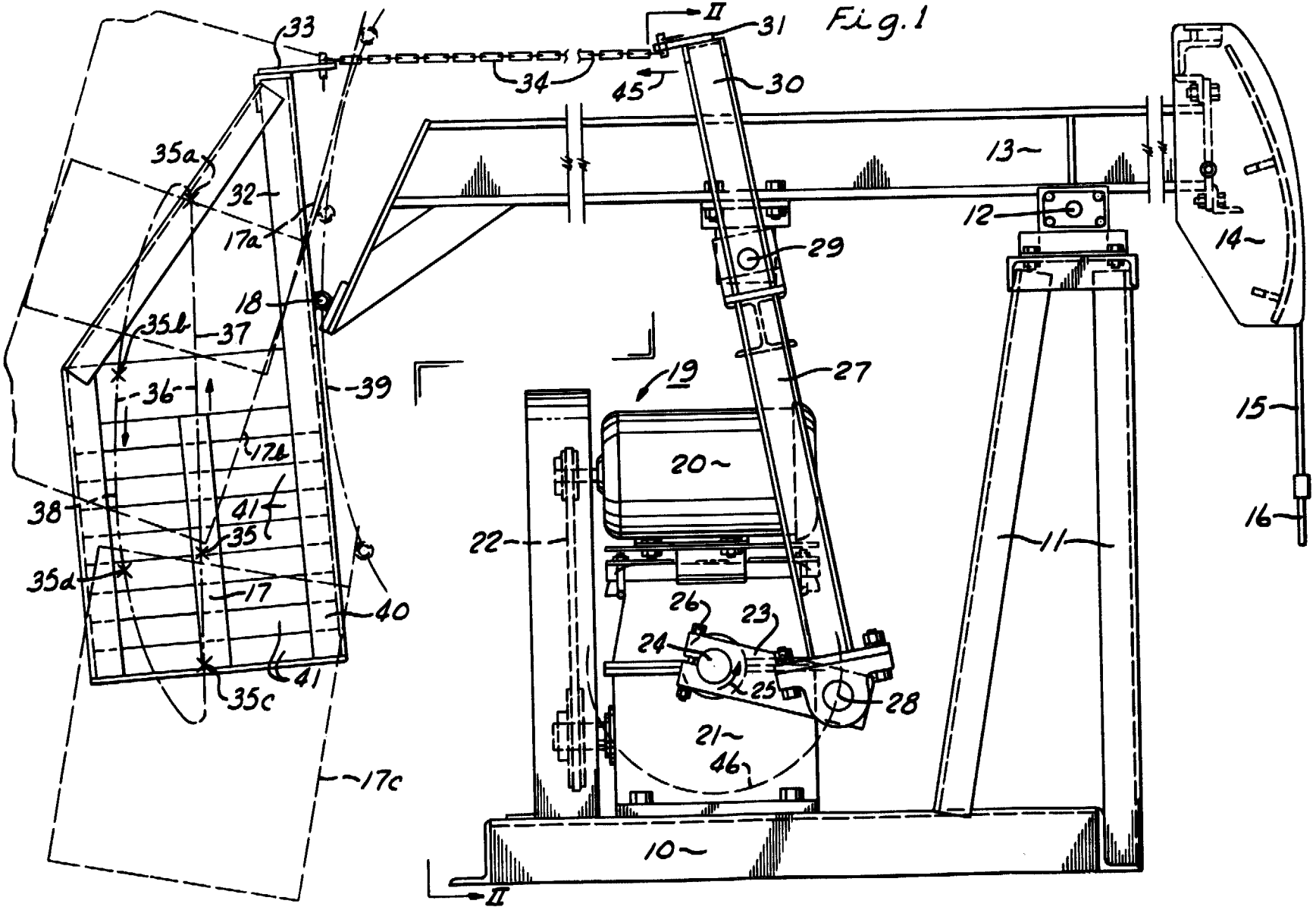
FIG. 1 is a view in side elevation of one embodiment of a well pump apparatus constructed in accordance with the teachings of the present invention.
Figure 2:
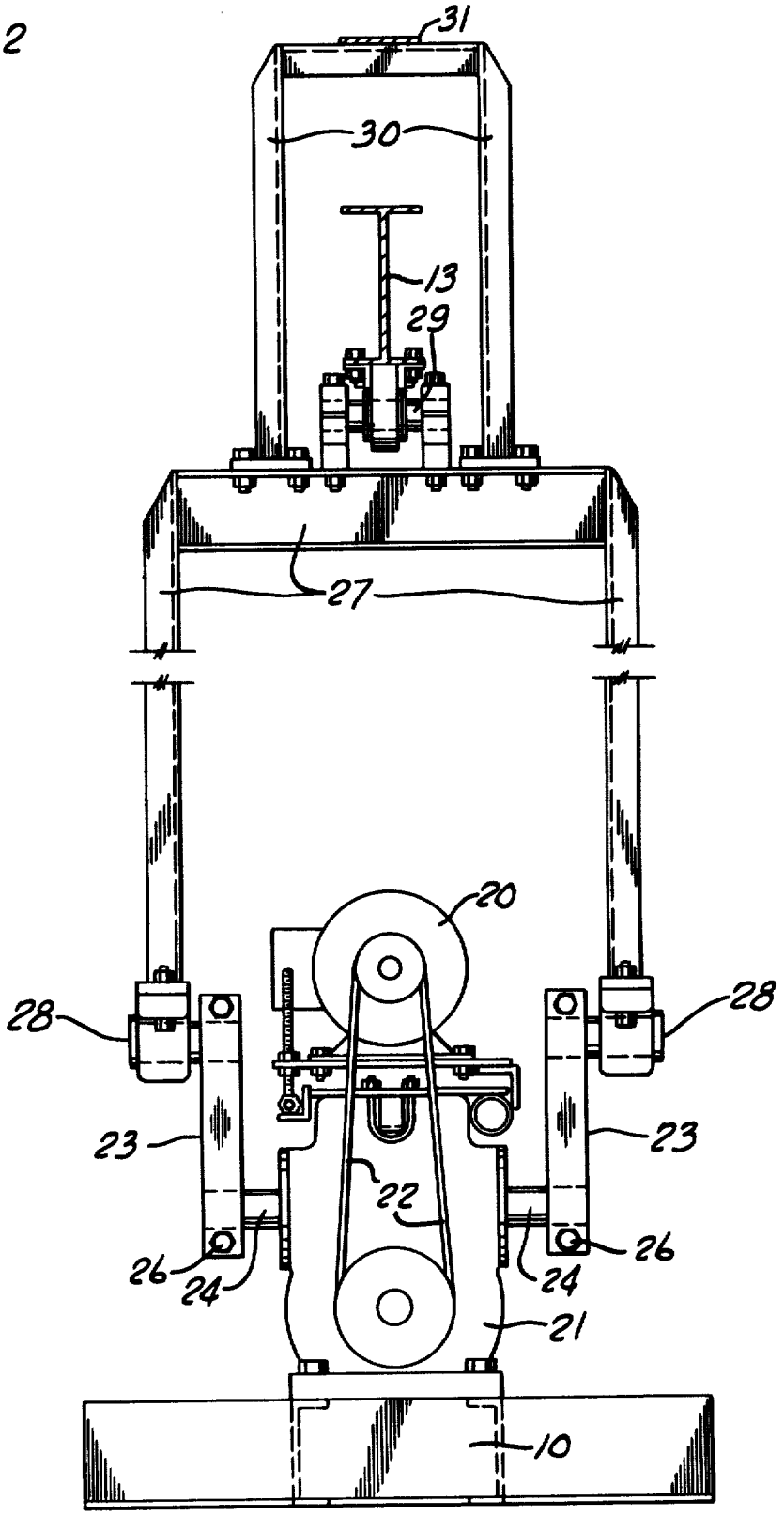
FIG. 2 is an end view in partial section of the embodiment of the invention illustrated in FIG. 1 as seen along section line II—II, and with portions such as the mule head and Samson post removed for the sake of clarity.

Referring to FIGS. 1 and 2, the well pumping apparatus comprises a platform or base 10 adjacent one end of which is mounted the Samson post 11, having pivotally mounted at Samson pivot 12 on the upper end thereof walking beam 13. At the right-hand end portion, the walking beam 13 carries mule head or horse head 14 to which is attached cable 15 connected with polish rod 16, which, in turn carries a string of sucker rods (not shown) for the well. At the left end portion of walking beam 13, the beam carries counterbalancing weight 17 which is hingedly connected by hinge 18 to the left end portion of walking beam 13 for swinging movement of weight 17 about an axis of hinge 18 which is parallel with the axis of Samson pivot 12.

A prime mover and pitman crank assembly 19 is operatively connected to rock walking beam 13 up and down about the Samson pivot 12 in operation through pumping cycles. The prime mover and pitman crank assembly 19 consists of the prime mover or electric motor 20 which is mounted directly on top of the speed reduction and gearing box assembly 21 in order to provide a very compact prime mover assembly which will not come into contact with or restrict the movement of counterbalancing weight 17 in its up and down movements during pumping cycles of walking beam 13.

Motor 20 directly drives gear reducer 21 by means of the V-belt pulley combination 22. Crank arm 23 has one end thereof connected to the prime mover or output shaft 24 of speed reduction and gearing box assembly 21 for rotation in a vertical plane and in the direction as indicated by arrow 25. Crank arm 23 is secured rigidly to output shaft 24 by means of the bolt clamp assembly 26.

Pitman or pitman post 27 is pivotally connected at its bottom end thereof to the other end of crank arm 23 by means of crank pin 28 and pitman pivot 29 pivotally connects the other end of pitman post 27 to walking beam 13 in order that this pitman crank assembly will rock walking beam 13 up and down about Samson pivot 12 when driven by the prime mover which consists of the combination of motor 20 and speed reduction and gearing box assembly 21.

A pitman arm extension 30 of pitman post 27 extends upwardly from the pitman pivot end of pitman post 27 to a free end position 31 above pitman pivot 29. Counterweight 17 which is hingedly connected by hinge 18 to the left end portion of walking beam 13 is provided with leverage arm 32 which is rigidly secured to counterbalancing weight 17 and extends upwardly to a free end position 33 above hinge connection or hinge 18 and a connecting means 34 extends between and pivotally connects free ends 31 and 33 together. Connecting means 34 is here illustrated as a chain. Thus, connecting means 34 may be flexible or on the other hand, it may be a rigid arm. In any event, it is also desirable that connecting means 34 be adjustable in length for the reasons which will be described hereinafter. Here, the length of chain 34 may be changed by shortening or lengthening the length of the chain at free end 33. This lever arm connection between counterbalancing weight 17 and pitman 27 drives counterbalancing weight 17 relative to walking beam 13, or in other words, hingedly moves counterbalancing weight 17 relative to walking beam 13 to move the center of gravity 35 of counterbalancing weight 17 longitudinally relative to Samson pivot 12 during pumping cycles. One pumping cycle is defined as one complete rotation of crank arm 33 or completion of one full upstroke and one full downstroke or rocking stroke of walking beam about Samson pivot 12. Thus, this linkage system acts as a control means to control the counterbalancing weight drive during each pumping cycle such that the center of gravity 35 of the counterbalancing weight is required to follow a predetermined vertical pattern of movement 36 throughout each pumping cycle, such that the center of gravity 35 travels in a substantially straight line 37 while traveling upward and in a line of curvature 38 directed outwardly away from Samson pivot 12 while traveling downward. While not absolutely required, straight line of movement 37 will generally be selected to be substantially vertical in order to be in parallel alignment with the alignment of the sucker rods and polish rods 16 in order to properly counterbalance the weight of the sucker rods during that portion of the pumping cycle wherein the pump sucker rods are being lowered into the well. The downward path of movement 38 of center of gravity 35 permits the counterbalance or counterbalance weight 17 to fully and effectively equal the weight of the sucker rods used to pump the liquid plus the weight of the liquid or fluid lifted by the pump. Thus, the pump is fully and effectively counterbalanced throughout each entire pumping cycle.

In order to more effectively illustrate how this leverage arm control connection between pitman 27 and counterweight 17 affects the movement of counterweight 17 throughout the pumping cycle, the counterweight 17 is illustrated in dashed outline in three other positions during a pumping cycle. Dashed outline 39 illustrates the arcuate movement of the end of walking beam 13 or hinge 18 throughout each pumping cycle. It should be noted that if counterweight 17 were rigidly connected to walking beam 13, the center of gravity would follow the same arcuate pattern as the hinge 18 through pumping cycles, which is extremely undesirable, as the pump cannot then be properly counterbalanced.

When counterweight 17 advances from its position as indicated in solid outline to the upper position as illustrated by dashed outline **17*a*, its center of gravity will be positioned at 35*a*, and the center of gravity for positions 35 to 35*a* will have traveled in a substantially straight line due to the controlled leverage effects, the length of lever arms, and position of pivots, selected for hinge 18, leverage arm 32, connecting rod or chain 34, pitman extension arm 30 and pitman pivot 29. The positioning of these pivots and the length of the respective lever arms mentioned dictates the vertical pattern 37 of travel for center of gravity 35**.

When counterweight 17 is being lowered, or on an upstroke of the pump, the aforementioned leverage arm control system swings the center of gravity 35 outwardly as indicated by the path of curvature movement 38 and the counterweight is tilted back or outwardly away from Samson pivot 12 such as indicated by the dashed outline position **17*b* of counterweight 17, wherein the center of gravity thereof is located at position 35*b* at that time to compensate for the added liquid being raised by the sucker rods. Dashed outline 17*c* indicates the position of the counterweight 17 at the point in time wherein the counterweight is just beginning its upstroke (the pump is just beginning its downstroke), and in this position, the center of gravity is indicated to be at position 35*c*. Center of gravity position 35*d* of counterweight 17 during the downward travel of counterweight 17 is indicated to illustrate what the position of the center of gravity of the counterweight will be at such time that crank arm 23 is positioned exactly 180° from the position illustrated in FIG. 1**.

Counterweight 17 is illustrated here in the form of a basket 40 which contains a stacked series of counterweight slabs 41 which may be slabs of concrete or metal. Thus, the amount of weight of counterbalance weight 17 may be readily varied by the number of weight slabs 41 positioned in basket 40 depending upon the depth or weight of the string of sucker rods which are supported from mule head 14.

In operation, the proper amount of weight slabs 41 are positioned in basket 40 to properly counterbalance the weight of the sucker rods, and then the effective weight of the counterbalance 17 may be slightly varied or fine tuned by varying the length of connecting member 34 to bring the system into exact balance. This may be accomplished by reading an amp meter showing the amperage being supplied at all times during pumping cycles to electric motor 20. Counterbalancing weights 41 are inserted into basket 40 until the peak readings of the amp meter are at a minimum, and then the length of connecting elements 34 may be varied to reduce the peak amperage readings to even a lower minimum.

As previously pointed out, connecting means or member 34 is illustrated as a flexible chain, but in fact, may be a rigid arm with adjustable connections for length. It is important to note that throughout the entire pumping cycle, counterweight 17 continually maintains connecting member 34 under tension, as illustrated by the tension arrow 45 which indicates that the downward moment of counterbalancing weight about hinge 18 continually pulls against chain 34. This force continually acting through the pitman post 27 and pitman post extension 30 acts to continually assist the prime mover consisting of motor 20 in driving engagement with gear reduction 21 throughout the entire half of a pumping cycle wherein crank arm 23 travels through its lower 180° of movement as illustrated by dashed arc 46. Thus, this forced assist which is applied to the output shaft 24 of gear reducer 21 acts to helpfully redistribute the loads normally placed on the prime mover during pumping cycles on conventional pitman crank prime movers to a more uniform load distribution throughout the pumping cycle. In this manner, peak amperage supply readings to the motor 20 are even further reduced by this assist effect throughout each pumping cycle.

To explain this assist effect in a different manner, in the conventional pitman crank type pump jack, the counterweight is rigidly secured to the end of the walking beam, and there is no leverage arm system such as disclosed herein. In such conventional pump jacks there is no additional assist provided for the prime mover of the type described herein throughout any portion of the pumping cycle. This assist provided by the linkage system of the pump jack of the present invention also tends to reduce wear on the gears in speed reduction and gearing box assembly 21.

Figure 3:
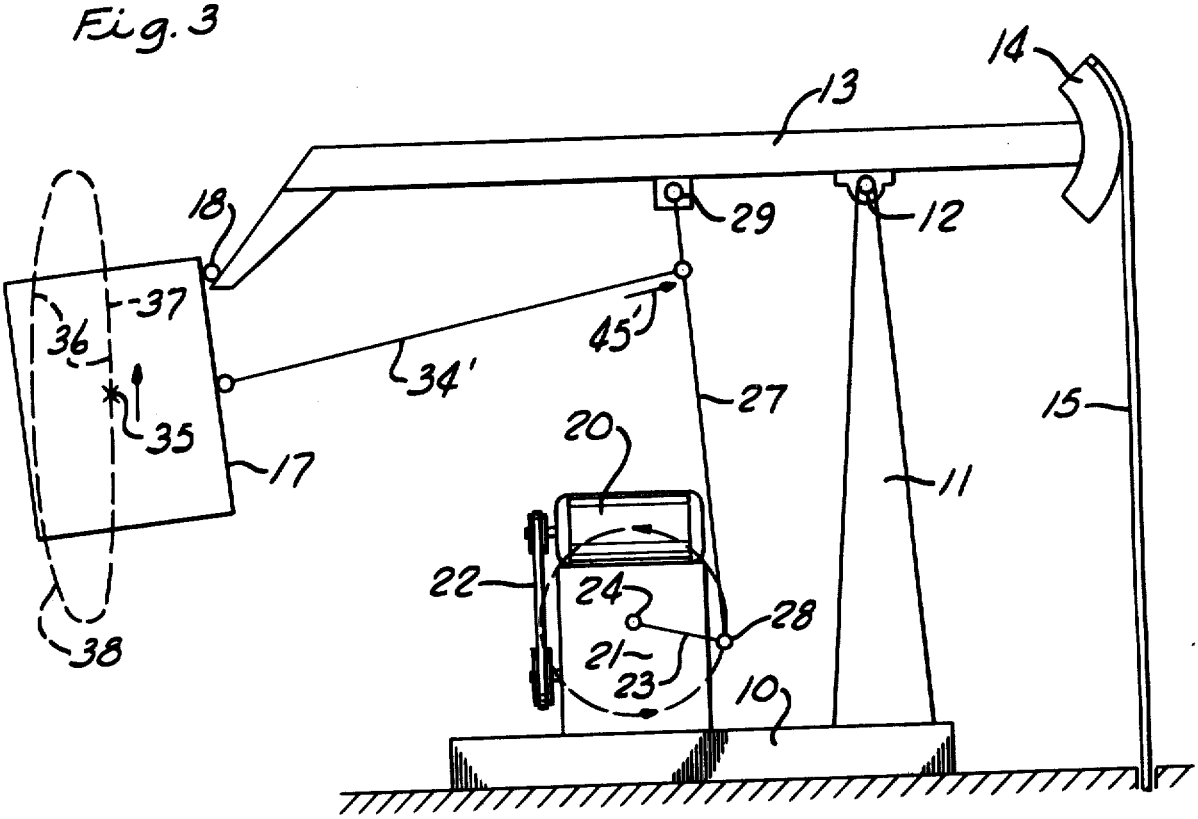
FIG. 3 is a diagrammatic view in side elevation of another embodiment of a well pump apparatus constructed in accordance with the teachings of the present invention.

Referring next to FIG. 3, another embodiment of the pump jack of the present invention is illustrated and accordingly, like elements are designated with the same reference numerals. In this embodiment, the lever arm means illustrated at 34' is provided below the walking beam 13 instead of above the walking beam 13 as illustrated in FIGS. 1 and 2. Here, leverage arm means 34' is a rigid leverage arm pivotally connecting counterbalancing weight 17 with pitman post 27. Accordingly, counterbalance weight 17 continually applies compression forces as indicated by arrow 45' to arm 34'. Thus, this leverage control system does apply some assist in the same manner as described in conjunction with the apparatus of FIGS. 1 and 2, but the assist is much less due to the fact that this leverage system disclosed in FIG. 3 is such that the force illustrated by arrow 45' and as transmitted through pitman post 27 is of a smaller value for assisting in the rotation of crank arm 23 and output shaft 24 during the bottom portion of rotation of crank 23.

With this embodiment of FIG. 3, the center of gravity 35 of counterweight 17 is effectively moved through the desired vertical pattern of movement 36; however, the linkage system of FIG. 3 is not as desirable as that illustrated in FIGS. 1 and 2 for the reason that the vertical upward path of movement 37 for center of gravity 35 is still a substantially straight line but nevertheless it has some undesirable curvature. It is ideal to have path of movement 37 to be as straight as possible in order to fully counterbalance the sucker rods for the full or entire downstroke of the pump.

I claim:

1. A well pumping apparatus having a Samson post, a walking beam pivotally mounted intermediate its end portions on said Samson post, means to connect a string of sucker rods to one end portion of said walking beam, a counterbalancing weight carried by the other end portion of said walking beam and connected to said walking beam for relative movement thereto, prime mover means operatively connected to said walking beam to rock said walking beam up and down on said Samson post in operation through pumping cycles, and counterbalancing weight drive means operatively connected to said counterbalancing weight to drive said counterweight in a predetermined path of movement relative to said walking beam during pumping cycles, the improvement comprising, control means to control said counterbalancing weight drive means during each pumping cycle such that the center of gravity of said counterbalancing weight is required to follow a predetermined vertical pattern of movement throughout each pumping cycle wherein the center of gravity travels in a substantially straight line while traveling upward and in a line of curvature directed outwardly away from the Samson pivot while traveling downwardly and wherein said control means is adapted to control said straight line of upward movement to be substantially vertical.

2. A well pumping apparatus having a Samson post, a walking beam pivotally mounted intermediate its end portions on said Samson post, means to connect a string of sucker rods to one end portion of said walking beam, counterbalancing weight means carried by the other end portion of said walking beam, a prime mover pitman crank assembly operatively connected to said walking beam to rock said walking beam up and down about the Samson pivot in operation through pumping cycles, the improvement comprising, said counterbalancing weight means including a counterbalancing weight hingedly connected to said other end portion of said walking beam for swinging movement about an axis parallel with the axis of the Samson pivot and lever arm means pivotally connecting said counterbalancing weight with said prime mover pitman crank assembly to hingedly move the center of gravity of said counterbalancing weight longitudinally relative to the Samson pivot during pumping cycles and thereby guide the center of gravity of said weight to follow a predetermined vertical pattern of movement throughout each pumping cycle of said walking beam, said lever arm means adapted in combination with said prime mover pitman crank assembly to guide said counterbalancing weight through said predetermined vertical pattern of movement wherein the center of gravity of the weight travels in a substantially straight line while traveling upward and in a line of curvature directed outwardly away from the Samson pivot while traveling downward.

3. The well pumping apparatus of claim 2, wherein said straight line of upward movement is substantially vertical.

4. The well pumping apparatus of claim 2, wherein said lever arm means consists, in combination, of a pitman arm extension of a pitman post in said prime mover pitman crank assembly which extends upwardly above said walking beam to a free end position, a leverage arm secured to said weight and extending upwardly therefrom to a free end position above said hinged connection, and connecting member extending between and pivotally connecting said free ends together.

5. The well pumping apparatus of claim 2, wherein said lever arm means consists of a rigid leverage arm pivotally connecting said counterbalancing weight with a pitman post in said prime mover pitman crank assembly at predetermined positions of connection below said walking beam.

6. The well pumping apparatus of claim 2, wherein said lever arm means is adjustable by changing at least one leverage adjustment selected from the group of adjustments consisting of moving pivot connection positions and linkage arm lengths between pivot positions in order to accordingly vary said predetermined vertical pattern of movement for the center of gravity of said counterbalancing weight.

7. The well pumping apparatus of claim 2, wherein said prime mover pitman crank assembly includes a prime mover consisting of a geared speed reduction assembly with a motor mounted on top thereof and connected in driving engagement therewith, said prime mover positioned under said walking beam between the Samson pivot and said other end portion of said walking beam to avoid contact by said counterbalancing weight during pumping cycles of said walking beam.

8. A well pumping apparatus having a Samson post, a walking beam pivotally mounted intermediate its end portions on said Samson post, means to connect a string of sucker rods to one end portion of said walking beam, a prime mover, a crank arm having one end thereof connected to said prime mover for rotation in a vertical plane, a pitman post pivotally connected at one end thereof to the other end of said crank arm and a pitman pivot pivotally connecting the other end of said pitman post to said walking beam for rocking said beam up down about the Samson pivot in operation through pumping cycles, a counterbalancing weight hingedly connected to said other end portion of said walking beam for swinging movement of said weight about an axis parallel with the axis of the Samson pivot, and lever arm means pivotally connecting said counterbalancing weight with said pitman post at predetermined positions of connection without intermediate engagement thereof with said walking beam to drive said weight through a predetermined pattern of vertical movement when said walking beam is rocking through each pumping cycle.

9. The well pumping apparatus of claim 8, wherein said lever arm means is adapted to hingedly move the center of gravity of said counterbalancing weight longitudinally relative to the Samson pivot during pumping cycles.

10. The well pumping apparatus of claim 8, wherein said lever arm means is adapted to guide said weight through said predetermined vertical pattern of movement wherein the center of gravity of the weight travels in a substantially straight line while traveling upward and in a line of curvature directed outwardly away from the Samson pivot while traveling downward.

11. A well pumping apparatus having a Samson post, a walking beam pivotally mounted intermediate its end portions on said Samson post, means to connect a string of sucker rods to one end portion of said walking beam, counterbalancing weight means carried by the other end portion of said walking beam, a prime mover and pitman crank assembly operatively connected to rock said walking beam up and down about the Samson pivot through pumping cycles; the improvement comprising in combination: said prime mover and pitman assembly including a crank arm having one end thereof connected to a prime mover for rotation in a vertical plane, a pitman post pivotally connected at one end thereof to the other end of said crank arm and a pitman pivot pivotally connecting the other end of said pitman post to said walking beam, and a pitman arm extension of said pitman post extending upwardly from the pitman pivot end of said pitman post to a free end position above said pitman pivot; a counterbalancing weight hingedly connected to said other end portion of said walking beam with the hinge axis thereof in substantially parallel alignment with the axis of the Samson pivot and leverage arm means secured to said weight and extending upwardly to a free end position above said hinged connection; and connecting means extending between and pivotally connecting said free ends together.

12. The well pumping apparatus of claim 11, wherein the length of said connecting means is adjustable.

13. The well pumping apparatus of claim 11, wherein said counterbalancing weight is adjustable.

14. The well pumping apparatus of claim 11, wherein said prime mover consists of a geared speed reduction assembly with a motor mounted on top thereof and connected in driving engagement therewith, said prime mover positioned under said walking beam between the Samson pivot and said other end portion of said walking beam to avoid contact by said counterbalancing weight during pumping cycles of said rocking walking beam.

15. The well pumping apparatus of claim 11, wherein said connecting means is continually under tension from the weight of said counterbalancing weight throughout each pumping cycle.

16. The method of counterbalancing an operating well pumping apparatus having a Samson post, a walking beam pivotally mounted intermediate its end portions on said Samson post, means to connect a string of sucker rods to one end portion of said walking beam, a counterbalancing weight carried by the other end portion of said walking beam, and power means operatively connected to said walking beam to rock said walking beam up and down in operation through pumping cycles, comprising the steps of connecting said counterbalancing weight to said walking beam for relative movement thereto, and driving said counterbalancing weight relative to said walking beam during each pumping cycle such that its center of gravity follows a vertical pattern of movement throughout each pumping cycle wherein the center of gravity travels in a substantially straight line while traveling upward and in a line of curvature directed outwardly away from the Samson pivot while traveling downward, and wherein the step of driving said counterbalancing weight is characterized in that said straight line of upward movement is controlled to be substantially vertical.

17. The method of claim 16, wherein the step of connecting said counterbalancing weight to said walking beam is carried out by hingedly connecting said counterbalancing weight to said walking beam for swinging movement of said weight.

18. The well pumping apparatus of claim 1, wherein said counterbalancing weight is hingedly connected to said walking beam for swinging movement of said weight.

* * * * *